United States Patent [19]

Montjallard et al.

[11] 4,068,557

[45] Jan. 17, 1978

[54] AUTOMATIC WEAPONS HAVING A CARTRIDGE BELT FEED

[76] Inventors: Paul René Montjallard, 25D rue Edmond Charpentier, 42000 St. Etienne; Joseph M. Laniel, Lotissement la Taille, 42390 Villars; Guillaume A. Gay-Chatain, 66 rue Marengo, 42000 St. Etienne, all of France

[21] Appl. No.: 732,441

[22] Filed: Oct. 14, 1976

[30] Foreign Application Priority Data

Oct. 15, 1975 France ..... 75 31480

[51] Int. Cl.[2] ..... F41D 9/02

[52] U.S. Cl. ..... 89/33 E

[58] Field of Search ..... 89/33 E

[56] References Cited

U.S. PATENT DOCUMENTS

| | | | |
|---|---|---|---|
| 2,403,170 | 7/1946 | Chapman et al. | 89/33 E |
| 2,557,441 | 6/1951 | Kornblum et al. | 89/33 E |
| 2,719,459 | 10/1955 | Peterson | 89/33 E |
| 3,090,880 | 5/1963 | Raymound | 310/268 |
| 3,144,574 | 8/1964 | Henry-Baudot | 310/268 |

FOREIGN PATENT DOCUMENTS

| | | | |
|---|---|---|---|
| 502,948 | 3/1939 | United Kingdom | 89/33 E |

*Primary Examiner*—Stephen C. Bentley
*Attorney, Agent, or Firm*—Haseltine, Lake & Waters

[57] ABSTRACT

An automatic weapons fed by a cartridge belt comprising a trigger and a feed mechanism for feeding the cartridge belt by applying traction force to the belt to advance the belt from a casing in which the belt is placed in overlapping folds. A feed assisting mechanism is provided for applying additional traction to the belt and comprises a star-shaped rotor in mesh with the cartridge belt in a zone situated downstream of the feed mechanism and an electrical motor drivingly coupled to the rotor and coupled to the trigger to furnish a torque whose energization is controlled by the operation of the trigger so that each time the trigger is activated the motor is energized. The feed assisting mechanism is disposed on a guide passage for the cartridge belt disposed between the feed mechanism on the weapon and the casing for the belt.

13 Claims, 2 Drawing Figures

AUTOMATIC WEAPONS HAVING A CARTRIDGE BELT FEED

FIELD OF THE INVENTION

The invention relates to automatic weapons which are fed by a cartridge belt, notably to weapons having high firing speeds. The invention relates particularly to weapons of a mean caliber, for example, of 30 mm. as the firing speed of these weapons is very high, for the most part greater than 700 rounds per minute.

BACKGROUND OF THE INVENTION

In an automatic weapon fed by a cartridge belt, the belt generally has a great length and it is stored in a casing in overlapping coils and a guide passageway connects the casing to the feed apparatus of the weapon.

It is known that for high firing rates, substantial forces are brought into play due to the fact that the mass presented by the length of the belt must be put in movement and also due to the friction forces between the belt and the walls with which they are in contact (walls of the ammunition casing, guide passage, etc.).

Without special precautions, there can be produced firing errors such as faulty introduction of the cartridge in the chamber of the weapon, jamming of the weapon, etc.

It has therefore been proposed to avoid these firing errors by providing an apparatus for applying traction to the belt directly activated by the weapon but such apparatus includes complex mechanisms and necessitates sometimes a modification of the weapon.

SUMMARY OF THE INVENTION

An object of the present invention is to provide an apparatus for assisting the feed of the belt which does not include a complex feeding mechanism connecting it to the weapon nor does it necessitate an attached reserve of ammunition in the vicinity of the weapon. Furthermore, this apparatus does not require any modification whatsoever of the weapon.

The weapon according to the invention comprises a firing mechanism; an apparatus for feed of ammunition by a cartridge belt generally stored in a casing and applying a partial drag to the belt and is characterized in the provision of an apparatus to aid the feed of the belt essentially constituted by at least one star-shaped rotor in mesh with the cartridge belt in a zone situated between the ammunition casing and the feed apparatus, said star-shaped rotor being driven by an electric motor whose energization is controlled by the firing apparatus such that each time the firing apparatus is actuated, the motor is energized.

The term "electric" motor is intended to refer to the utilization of an electric motor which furnishes a torque output.

Thanks to this arrangement, there is obtained operation of the apparatus for assisting the feed independently of the weapon which therefore has no need of being modified.

The placement of the apparatus for assisting the belt feed can be anywhere between the ammunition casing and the feed apparatus of the weapon, but in order to provide maximum benefit of assistance for the feed apparatus of the weapon, it is preferred to dispose the assisting apparatus as close as possible to the weapon.

The motor of the assisting apparatus serves to apply an auxiliary traction force on the belt to lower the corresponding required traction in the feed apparatus of the weapon.

It is suitable to note additionally that due to the characteristics of electrical motor-couples, the speed of rotation of the assisting apparatus adapts itself to the speed of advance of the cartridge belt and therefore to the firing rate and no synchronization whatsoever is therefore necessary between the weapon and the apparatus for the assistance of the feed.

The invention will become better understood from the detailed description which follows with reference to the annexed drawing which shows a preferred embodiment of the invention without any limiting character whatsoever.

DETAILED DESCRIPTION

Figure 1:
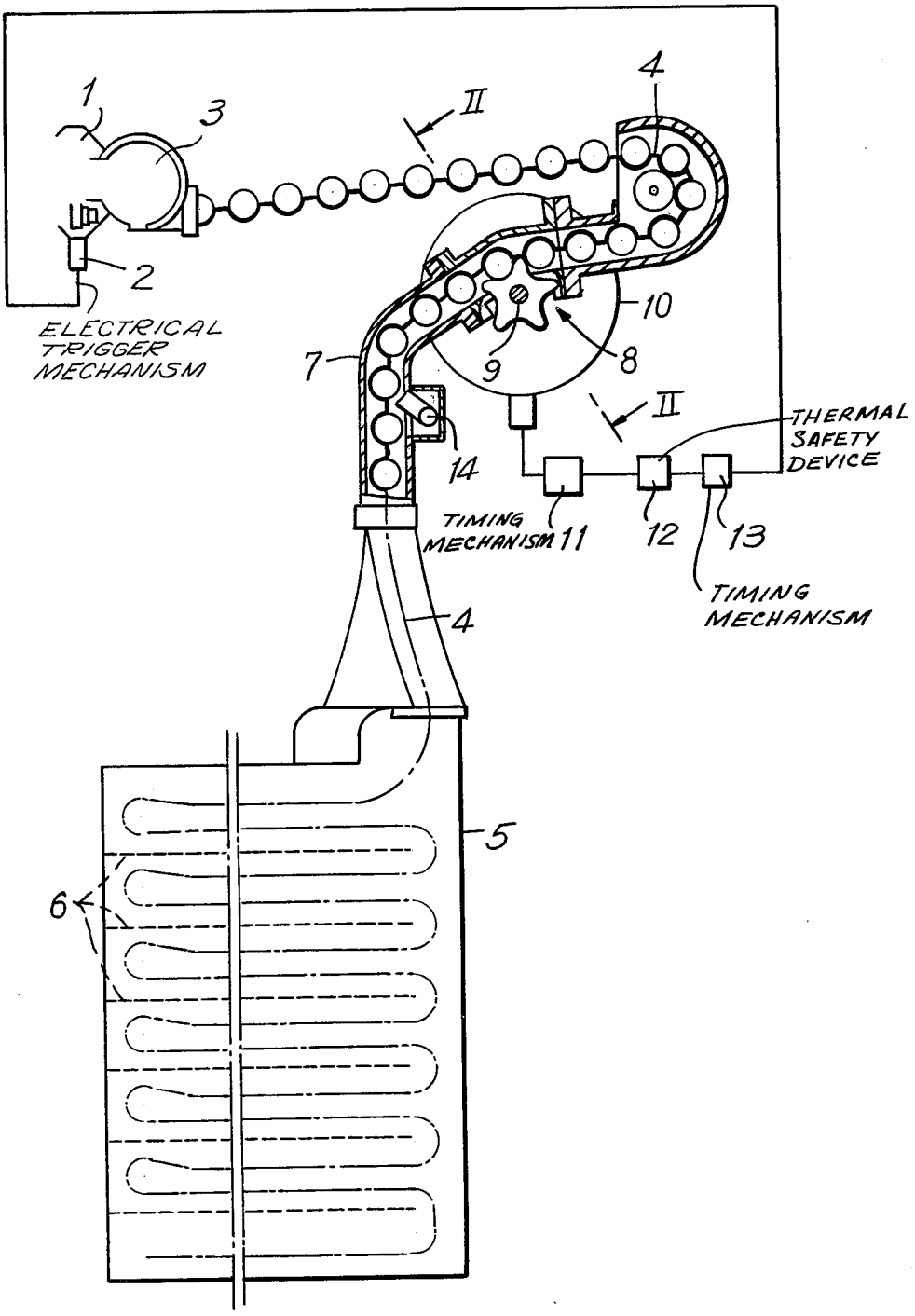
FIG. 1 schematically shows a weapon with the improvement according to the invention.

In FIG. 1 there is schematically shown a weapon 1 comprising a firing apparatus 2, such as, for example, an electrical trigger, and an apparatus 3 for feed of ammunition by a cartridge belt 4.

The cartridge belt 4 is stored in an ammunition casing 5 where it is wound in coils at different levels 6. A guide passage 7 connects the ammunition casing 5 to the feed apparatus 3 of the weapon.

Figure 2:
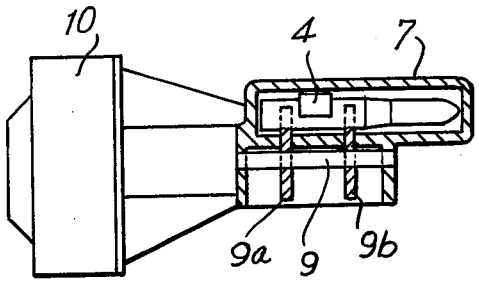
FIG. 2 is a sectional view taken along line II—II in FIG. 1.

The weapon additionally comprises an apparatus for assisting the feed of the belt designated generally by reference numeral 8 and which is essentially constituted by a rotor 9 for example, comprising two stars **9*a* and 9*b* (FIG. 2), in mesh with the cartridge belt 4. The rotor 9 is driven by an electrical motor 10 which is energized in correspondence with firing apparatus 2** in that each time the firing apparatus is activated the motor is energized.

The feed assisting apparatus 8 is advantageously disposed on the guide passage 7 as close as possible to the weapon 1.

The electrical motor 10 can be a direct current motor having a laminated coil and a planar air gap; such a motor can furnish a torque while turning, but it can also apply a torque without turning when the resisting torque is equal to the motor torque.

The limits of utilization of the electrical motor is its overheating which must not produce a temperature greater than a critical temperature which is a function of the working conditions and the thermal exchange between the motor and the environment.

It is advantageous to utilize an underfed motor, for example, with a voltage of 6 to 10 times less than the nominal value of feed.

Two modes of operation of the motor take place, at the time of feed of the cartridge belt during the firing of the weapon, the motor turns in synchronization with the belt and furnishes a torque to assist the feed apparatus of the weapon, and at the time of firing between the moment when the firing apparatus is activated and the time when the first cartridge is fired, the motor is then not turning but furnishes a torque to ease the feed apparatus of the weapon; this interval does not exceed 100 ms.

The operation of the weapon is, thus, the following.

When the operator activates the firing apparatus, the motor of the feed assistance apparatus is energized and reaches its nominal torque (motor not turning) in 20 ms whereas the feed cycle of the weapon only permits a percussion of the cartridge in its firing chamber after 60 ms.

When the first cartridge is fired, the movable assembly of the weapon, constituted by the breech block and the manipulating member, is then moved rearwardly and activates the feed apparatus of the weapon to engage a new cartridge in the chamber.

If the firing then continues the motor of the feed assisting apparatus continues to furnish a torque by turning at the speed imposed by the feed of the cartridge belt and, therefore at the rate of fire.

When the operator releases the firing apparatus, the motor of the feed assisting apparatus is no longer, in principle, energized.

However, it is advantageous to provide a timing mechanism 11 adjusted for a duration of about 100 ms to keep the motor 10 of the feed assisting apparatus 8 energized in such a manner that the feed apparatus 3 will be assisted in the ultimate operation of introduction of a cartridge in the chamber which can be effected when the operator ceases acting on the firing mechanism and when the movable assembly of the weapon leaves its rear position. The duration of timing of about 100 ms corresponds to about 1 cycle of feed of the weapon.

It is therefore conceived, in these conditions, and which would be the case for any type of firing of the weapon (rapid fire or single fire) that the feed apparatus of the weapon is already assisted or even assisted when the operation of introduction of a new cartridge is produced.

It is suitable to note that when one arrives at the end of the cartridge belt or when for various reasons one utilizes a much shorter belt, the feed assisting apparatus can furnish a motor torque greater than the resisting torque and the feed assisting apparatus can, thus, push the ammunition belt toward the feed apparatus of the weapon; experience has shown, however, that these condtions of operation do not disturb the feed apparatus because, in fact, the cartridges come into contact with one another in the feed passageway (not shown) and they are not forceably engaged in the feeding apparatus.

When the extremity of the ammunition belt has left the feed assisting apparatus, the resisting torque then becomes zero, the motor then reaching a free speed which it maintains until the operator ceases action on the firing mechanism.

At the time of a firing fault, the operator could continue to act on the firing mechanism. Under these conditions and to avoid an overheating of the motor 10 of the feed assisting apparatus 8, a thermal safety device 12 is provided to cut the feed of the motor 10 at the end of about 1 s.

In the normal operation of the weapon, the motor 10 of the feed assisting apparatus 8 turns at a relatively slow speed which is imposed by the rate of fire of the weapon; as a consequence and to avoid overheating of the motor, its energization is automatically cut at the end of a critical time duration which can be, for example, 20 s, due to the provision of a timing mechanism 13. This could be constituted by an electronic assembly controlling a relay. In any event, the value of this critical time corresponds to an abnormal time of continuous utilization of the weapon and in principle will never be obtained.

Finally, it is suitable to note that if the motor 10 of the feed assisting apparatus 8 should become inoperative, the weapon would continue to fire, as the motor 10 freely turning the apparatus 8, would not lead to any interference with the feed of the ammunition belt; the weapon would thus operate, but with all of the disadvantages of feed of a conventional ammunition belt, necessitating a substantial force.

From the constructive point of view, it is suitable to note that a retaining pawl 14 can be disposed between the apparatus 8 and the ammunition casing 5.

This being the case and whatever would be the embodiment, there is thus provided for the feed apparatus of the weapon, means for assisting the feed of the ammunition by the presence of an extremely simple traction apparatus which is reliable and which intervenes whatever the firing conditions.

Furthermore, this effective assistance of the feed apparatus of the weapon allows the disposition of the ammunition casing relatively far from the weapon which in certain cases can facilitate the installation of the weapon.

By way of example, on a turret provided with a 20 mm cannon, the static traction force of the longest belt of explosive ammunition is an average of 350 newtons measured by a dynamometer. The traction apparatus itself of this type of weapon is incapable of pulling this length of band. If one installs the apparatus according to the invention, the traction force measured under the same condtions is only 150 newtons. Therefore, the gain realized by the reduced traction of the longest standard belt is of the order of 60%.

What is claimed is:

1. In an automatic weapon fed by a cartridge belt and comprising a trigger and feed means for feeding the cartridge belt by applying traction force to the belt, an improvement comprising feed assisting means for applying additional traction to the belt comprising at least one star-shaped rotor in mesh with the cartridge belt in a zone situated downstream of the feed means and an electrical motor directly drivingly coupled to said rotor and coupled to said trigger to furnish a torque whose energization is controlled by the operation of the trigger such that each time the trigger is activated the motor is energized, said motor being a direct current motor having a laminated coil and planar air gap and including an output shaft directly coupled to said rotor in driving engagement, said motor being underfed in voltage and being capable of periodic stoppage during stoppage of the belt while continuing to deliver torque to said rotor without overheating the motor.

2. The combination as claimed in claim 1 wherein said feed assisting means is disposed in immediate proximity to the weapon.

3. The combination as claimed in claim 1 comprising an ammunition casing in which the cartridge belt is coiled, a guide passage connecting said ammunition casing to said feed means of the weapon, said feed assisting means being disposed on said guide passage.

4. The combination as claimed in claim 1 wherein said direct current motor is fed by a voltage 6 to 10 times less than the nominal feed voltage.

5. The combination as claimed in claim 1 comprising a timing apparatus coupled to said motor to keep the same energized when the trigger is released, for a period of time corresponding approximately to one feed cycle of the weapon.

6. The combination as claimed in claim 1 comprising a thermal safety device coupled to the motor to deenergize the same in case of overheating of said motor.

7. The combination as claimed in claim 1 comprising a retaining pawl upstream disposed of the feed assisting means.

8. In an automatic weapon fed by a cartridge belt and comprising a trigger and feed means for feeding the cartridge belt by applying traction force to the belt, an improvement comprising feed assisting means for applying additional traction to the belt comprising at least one star-shaped rotor in mesh with the cartridge belt in a zone situated downstream of the feed means, an electrical motor drivingly coupled to said rotor and coupled to said trigger to furnish a torque whose energization is controlled by the operation of the trigger such that each time the trigger is activated the motor is energized and timing means coupled to said motor to deenergize the same at the end of a selected time interval at least equal to the normal time of continuous usage of the weapon.

9. The combination as claimed in claim 8 wherein said motor is a direct current motor having a laminated coil and a planar air gap.

10. In an automatic weapon fed by a cartridge belt and comprising a trigger and feed means for periodically feeding the cartridge belt by applying traction force to the belt, a method comprising applying additional traction to the cartridge belt by meshing at least one star-shaped rotor with the cartridge belt in a zone situated downstream of the feed means and driving the rotor by an electrical motor directly drivingly coupled to said rotor and coupled to said trigger to furnish a torque whose energization is controlled by the operation of the trigger such that each time the trigger is activated the motor is energized, constructing the motor as a direct current motor having a laminated coil and planar air gap and an output shaft directly coupled to the rotor, and underfeeding the motor in voltage to permit periodic stoppage thereof during stoppage of the belt, while continuing to deliver torque to said rotor without overheating the motor.

11. A method as claimed in claim 10 wherein said direct current motor is fed by a voltage 6 to 10 times less than the nominal feed voltage.

12. A method as claimed in claim 10 comprising keeping the motor energized when the trigger is released for a period of time corresponding approximately to one feed cycle of the weapon.

13. A method as claimed in claim 10 comprising deenergizing the motor at the end of a selected time interval at least equal to the normal time of continuous usage of the weapon.

* * * * *